US011286598B2

(12) United States Patent
Asami et al.

(10) Patent No.: US 11,286,598 B2
(45) Date of Patent: Mar. 29, 2022

(54) LOWER THREAD SUPPLY DEVICE OF SEWING MACHINE

(71) Applicants: JUKI CORPORATION, Tokyo (JP); TOWA JAPAN Corporation, Niigata (JP)

(72) Inventors: Takeshi Asami, Tokyo (JP); Jun Wakatabe, Tokyo (JP); Kazuyuki Yada, Niigata (JP)

(73) Assignees: JUKI CORPORATION, Tokyo (JP); TOWA JAPAN Corporation, Niigata (JP)

( * ) Notice: Subject to any disclaimer, the term of this patent is extended or adjusted under 35 U.S.C. 154(b) by 109 days.

(21) Appl. No.: 16/819,151

(22) Filed: Mar. 15, 2020

(65) Prior Publication Data

US 2020/0291562 A1 Sep. 17, 2020

(30) Foreign Application Priority Data

Mar. 15, 2019 (JP) ..... JP2019-049157

(51) Int. Cl.

| | |
|---|---|
| ***D05B 57/28*** | (2006.01) |
| ***D05B 47/04*** | (2006.01) |
| ***D05B 57/10*** | (2006.01) |
| ***D05B 57/26*** | (2006.01) |

(52) U.S. Cl.

CPC ..... *D05B 57/28* (2013.01); *D05B 47/04* (2013.01); *D05B 57/10* (2013.01); *D05B 57/26* (2013.01)

(58) Field of Classification Search

CPC ..... D05B 57/10; D05B 57/12; D05B 57/14; D05B 57/143; D05B 57/26; D05B 57/28; D05B 47/04

See application file for complete search history.

(56) References Cited

U.S. PATENT DOCUMENTS

2004/0245364 A1* 12/2004 Kronenberger ..... D05B 57/265 242/419.3
2012/0097084 A1* 4/2012 Takizawa ..... D05B 57/38 112/229

FOREIGN PATENT DOCUMENTS

| | | |
|---|---|---|
| DE | 3003501 | 8/1980 |
| JP | S573680 | 1/1982 |
| JP | 2008023047 | 2/2008 |

(Continued)

OTHER PUBLICATIONS

"Search Report of Europe Counterpart Application", dated Sep. 4, 2020, p. 1-p. 7.

*Primary Examiner* — Nathan E Durham
(74) *Attorney, Agent, or Firm* — JCIPRNET

(57) ABSTRACT

A lower thread supply device of a sewing machine includes a bobbin, a bobbin case, a magnetic force member, and a magnetic force change portion. The bobbin has a cylindrical portion for inserting into a spindle of a shuttle, a shuttle side flange portion, and a front surface side flange portion which is magnetic, and a lower thread is wound around an outer circumference of the cylindrical portion between the shuttle side flange portion and the front surface side flange portion. The bobbin case has a non-magnetic cover portion having a front surface side part and a side wall part, housing the bobbin and transmitting a magnetic force. The magnetic force member is arranged at the front surface side of the bobbin case and attracts the front surface side flange portion of the bobbin by a magnetic force via the bobbin case.

9 Claims, 10 Drawing Sheets

(56) References Cited

FOREIGN PATENT DOCUMENTS

| | | |
|---|---|---|
| JP | 2009261551 | 11/2009 |
| JP | 4919332 | 4/2012 |

* cited by examiner

LOWER THREAD SUPPLY DEVICE OF SEWING MACHINE

CROSS-REFERENCE TO RELATED APPLICATION

This application claims the priority benefit of Japan application no. 2019-049157, filed on Mar. 15, 2019. The entirety of the above-mentioned patent application is hereby incorporated by reference herein and made a part of this specification.

BACKGROUND

Technical Field

The disclosure relates to a lower thread supply device of a sewing machine.

Related Art

Disclosed in patent literature 1 (Japanese Patent No. 4919332) is a technique in which tension of a lower thread of a sewing machine is changed by changing a screw-in amount of a tension adjustment screw arranged on a leaf spring arranged on an outer circumference of a bobbin case.

For the change of the screw-in amount of the tension adjustment screw, quantitative adjustment is difficult. As a result, it may be difficult to reproduce the adjustment of the tension of the lower thread of a sewing machine is difficult.

An aspect of the disclosure aims to facilitate the adjustment of the tension of a lower thread of a sewing machine.

SUMMARY

According to the aspect of the disclosure, a lower thread supply device of a sewing machine which is arranged below a needle plate of a sewing machine is provided, the lower thread supply device including: a bobbin which has a cylindrical portion for inserting into a spindle of a shuttle arranged below the needle plate, a shuttle side flange portion which is formed at an end portion at a shuttle side which is a side facing the shuttle in the cylindrical portion, and a front surface side flange portion which is magnetic and formed at an end portion at a front surface side which is a side opposite to the side facing the shuttle in the cylindrical portion, wherein a lower thread is wound around an outer circumference of the cylindrical portion between the shuttle side flange portion and the front surface side flange portion; a bobbin case which has a non-magnetic cover portion housing the bobbin and transmitting a magnetic force, wherein the cover portion has a front surface side part covering the front surface side of the bobbin and a side wall part covering an outer circumference side of the bobbin; a magnetic force member which is arranged at the front surface side of the bobbin case and attracts the front surface side flange portion of the bobbin by the magnetic force via the bobbin case; and a magnetic force change portion which changes the magnetic force of the magnetic force member acting on the front surface side flange portion.

Figure 4:
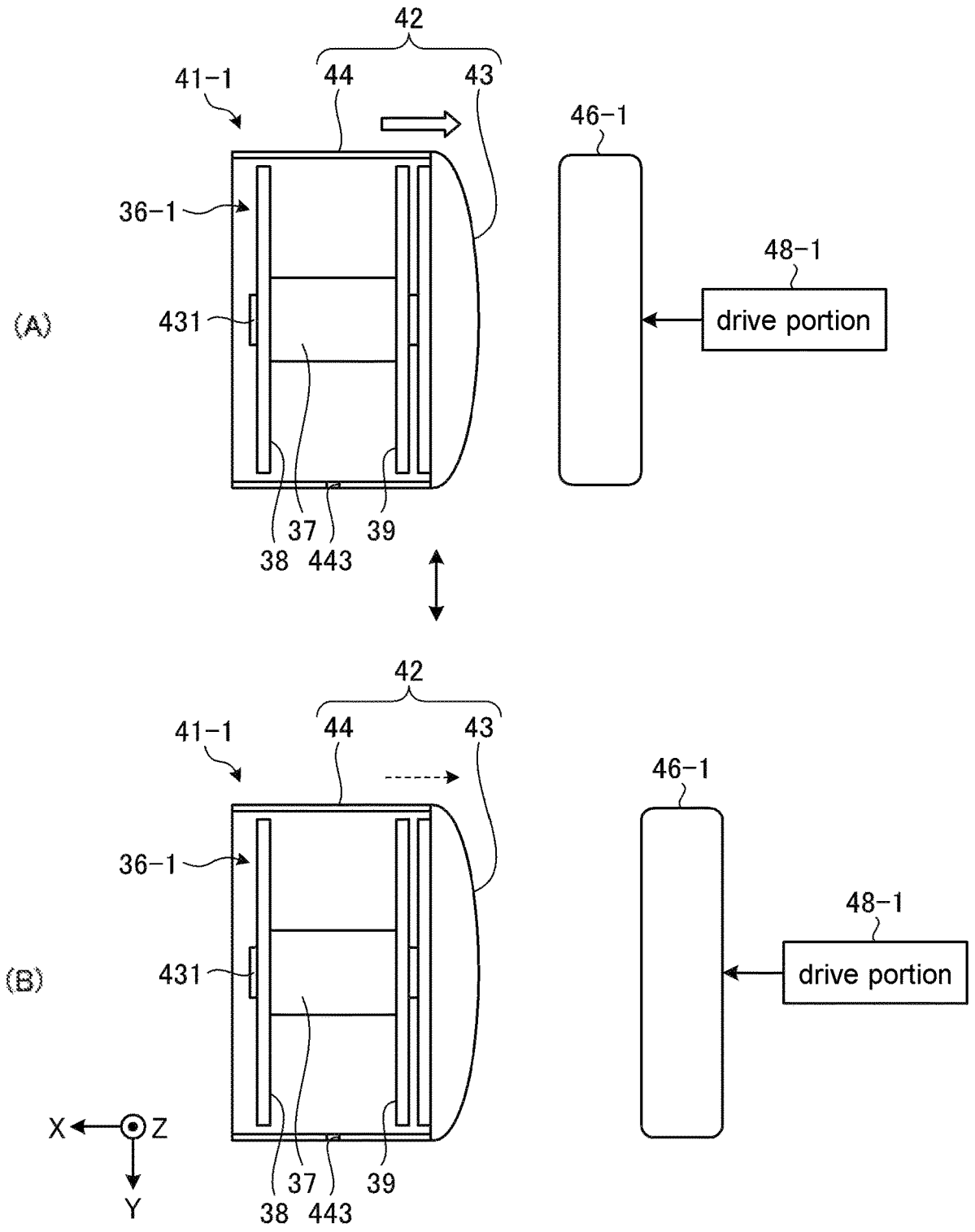

(A) and (B) of FIG. 4 are schematic diagrams showing a first example of the bobbin, the bobbin case and the magnetic force member according to the first embodiment.

Figure 5:
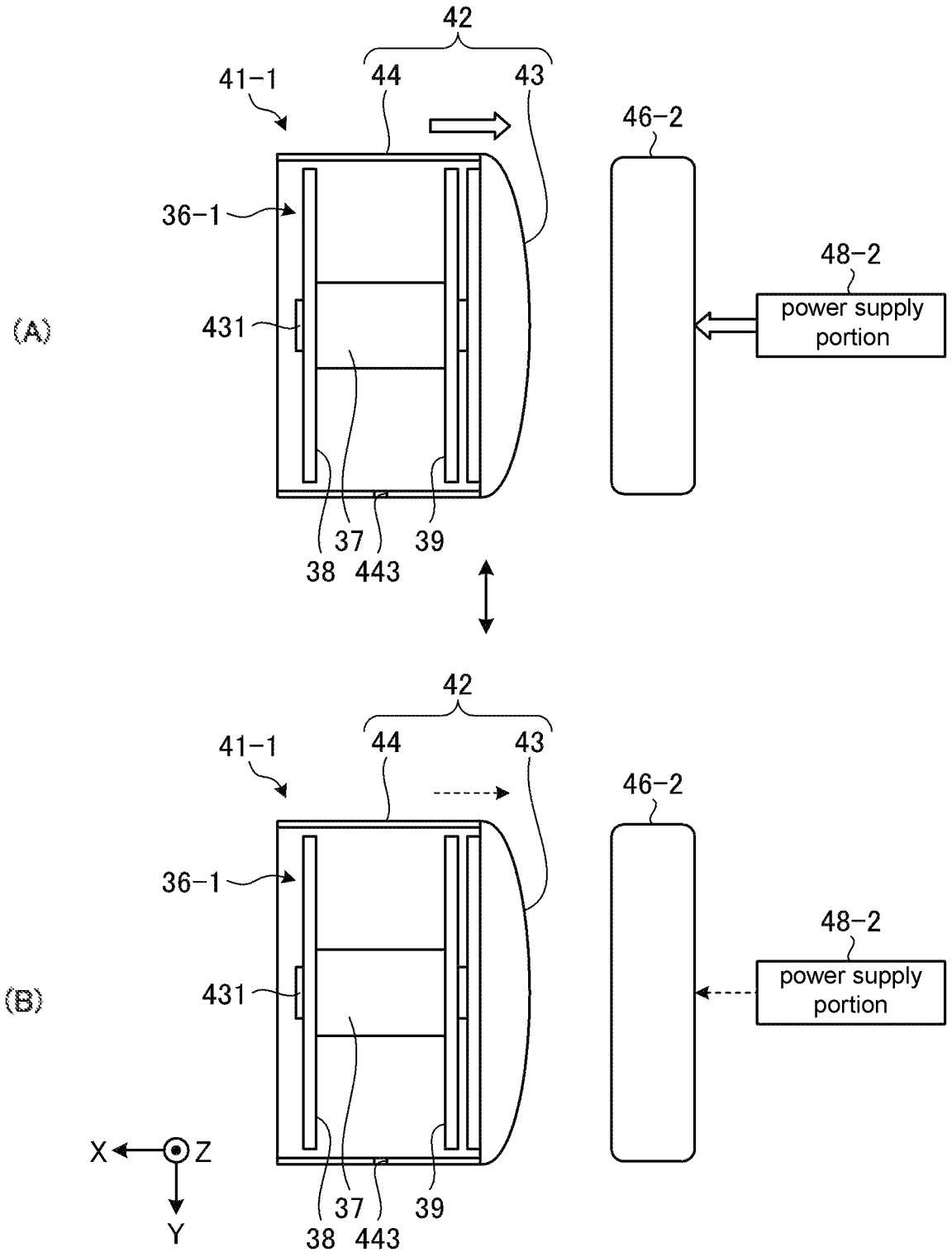

(A) and (B) of FIG. 5 are schematic diagrams showing a second example of the bobbin, the bobbin case and the magnetic force member according to the first embodiment.

Figure 6:
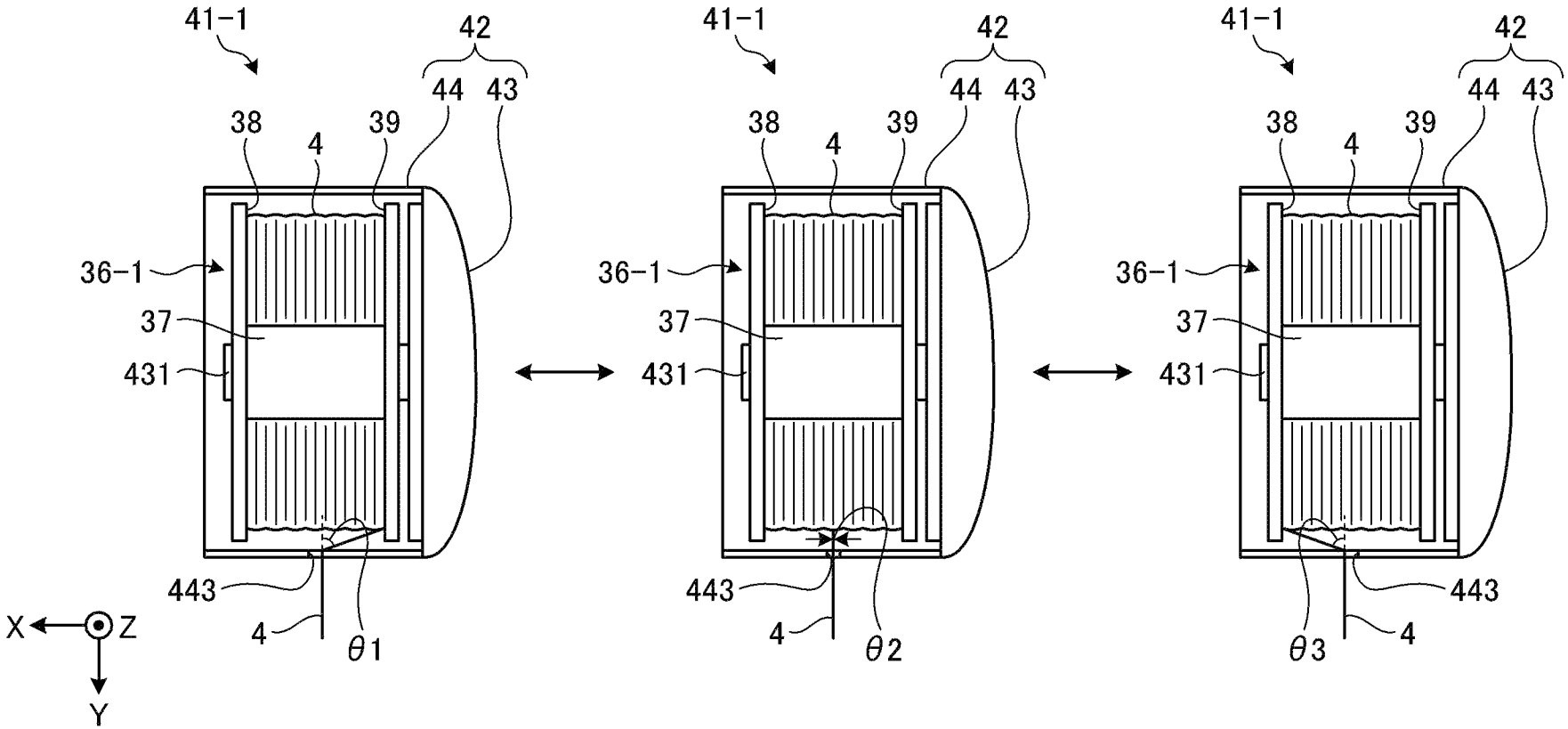

FIG. 6 is an illustration diagram illustrating a position of a thread feeding hole according to the first embodiment.

Figure 7:
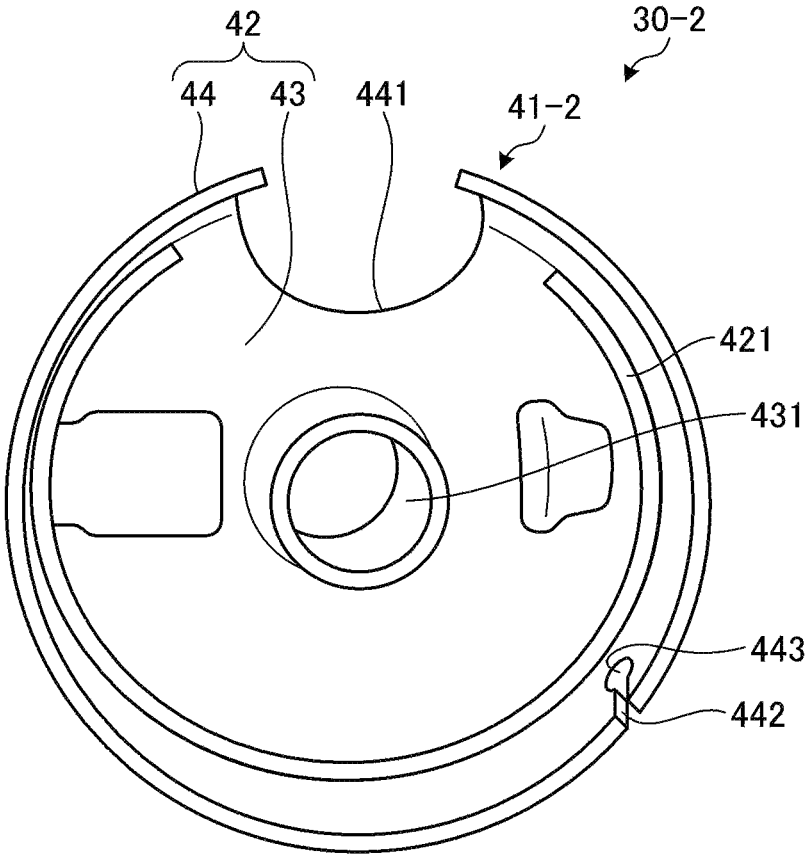

FIG. 7 is a perspective view showing an example of a bobbin case of a lower thread supply device of a sewing machine according to a second embodiment.

Figure 8:
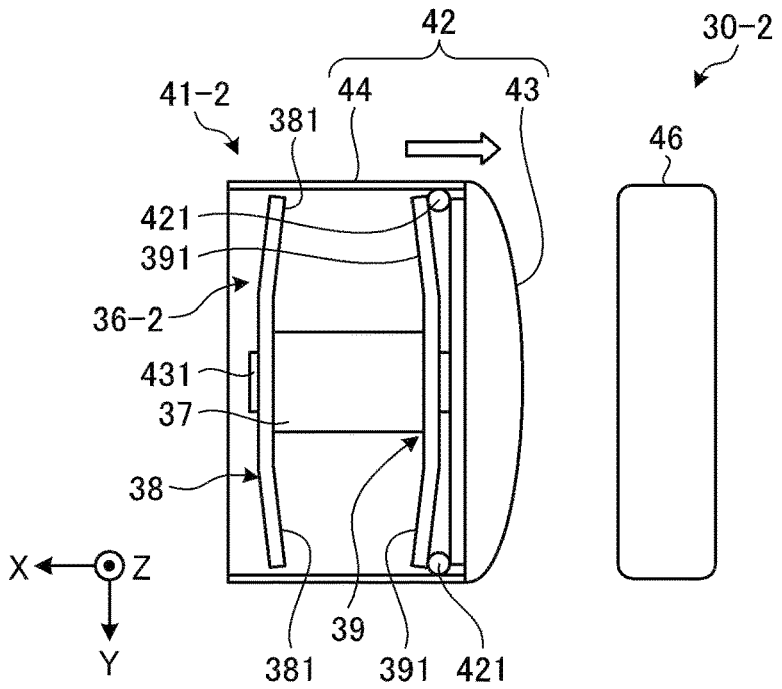

FIG. 8 is a schematic diagram showing an example of a bobbin, the bobbin case and a magnetic force member according to the second embodiment.

Figure 9:
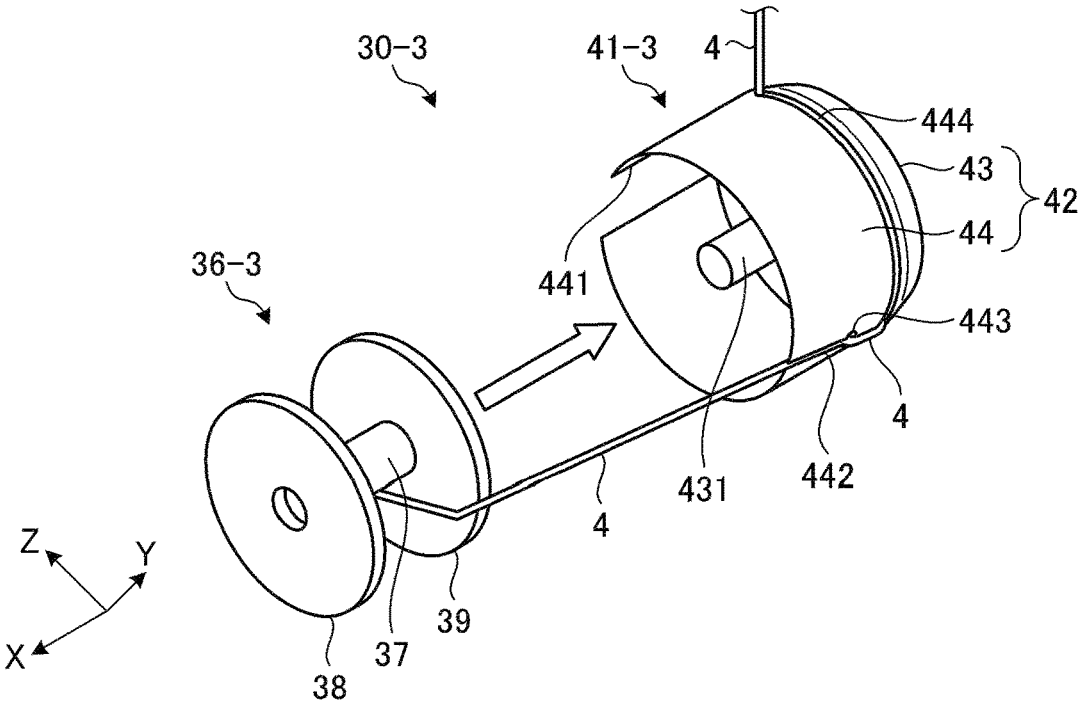

FIG. 9 is an exploded perspective view showing an example of a bobbin and a bobbin case in a lower thread supply device of a sewing machine according to a third embodiment.

Figure 10:
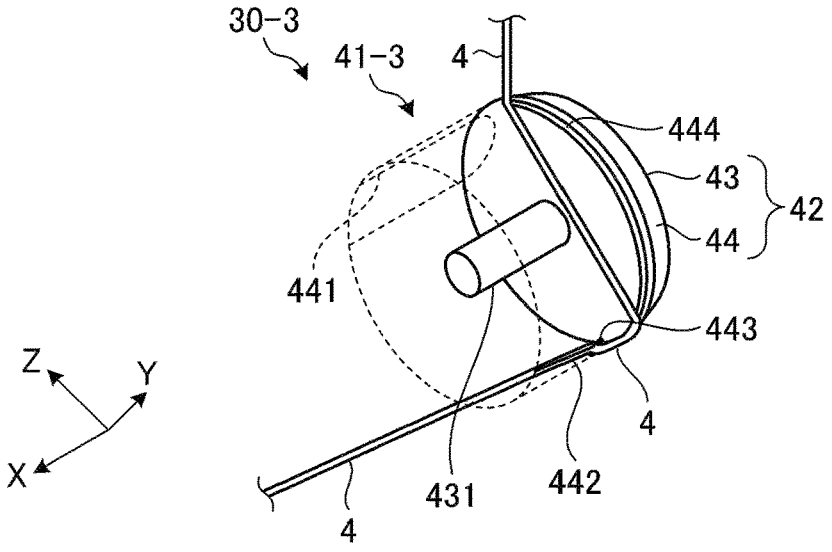

FIG. 10 is a perspective view showing an example of the bobbin case according to the third embodiment.

Figure 11:
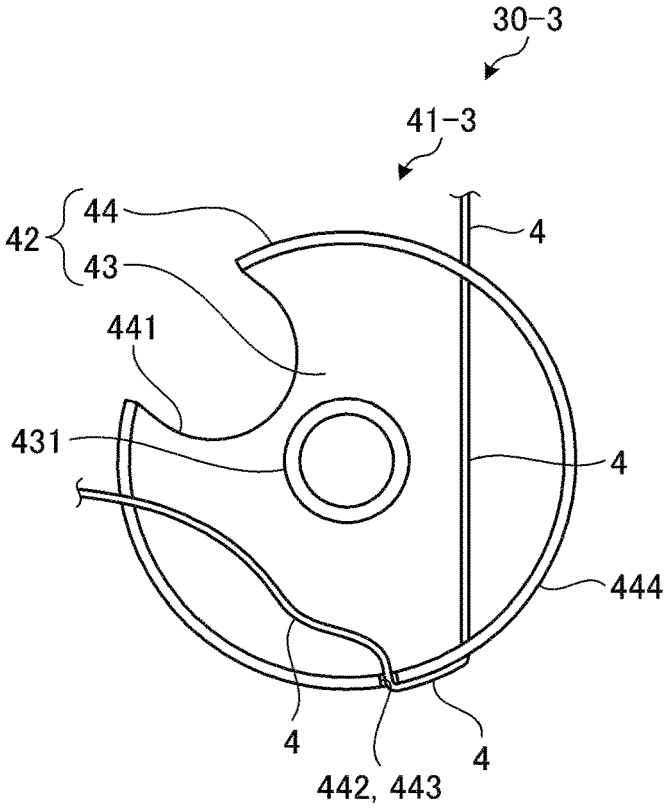

FIG. 11 is a plan view showing an example of the bobbin case according to the third embodiment.

Figure 12:
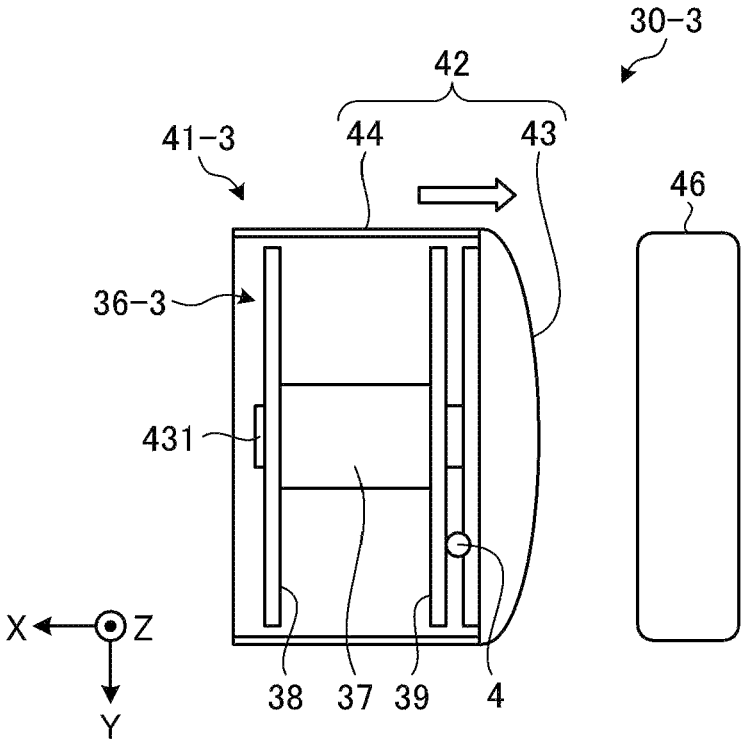

FIG. 12 is a schematic diagram showing an example of the bobbin, the bobbin case and a magnetic force member according to the third embodiment.

Figure 13:
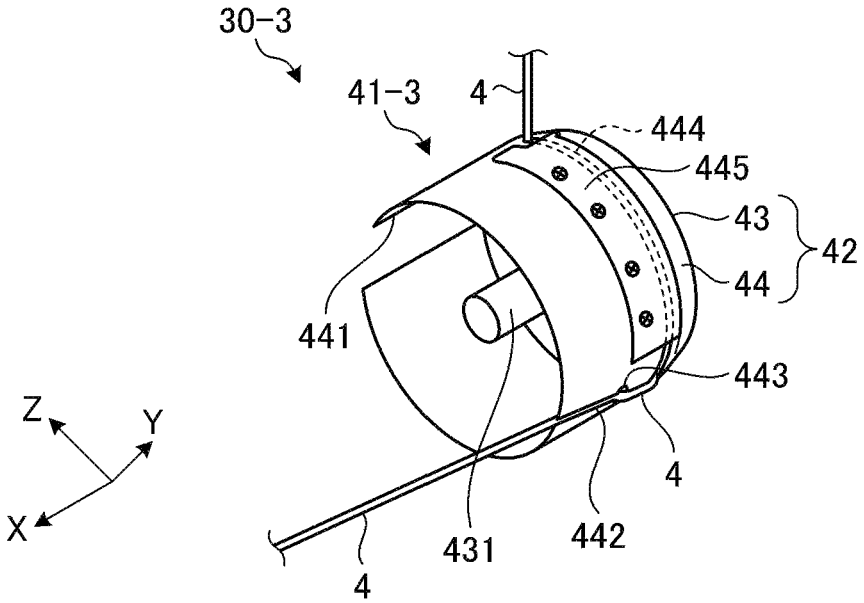

FIG. 13 is a perspective view showing a modification example of the bobbin case according to the third embodiment.

Figure 14:
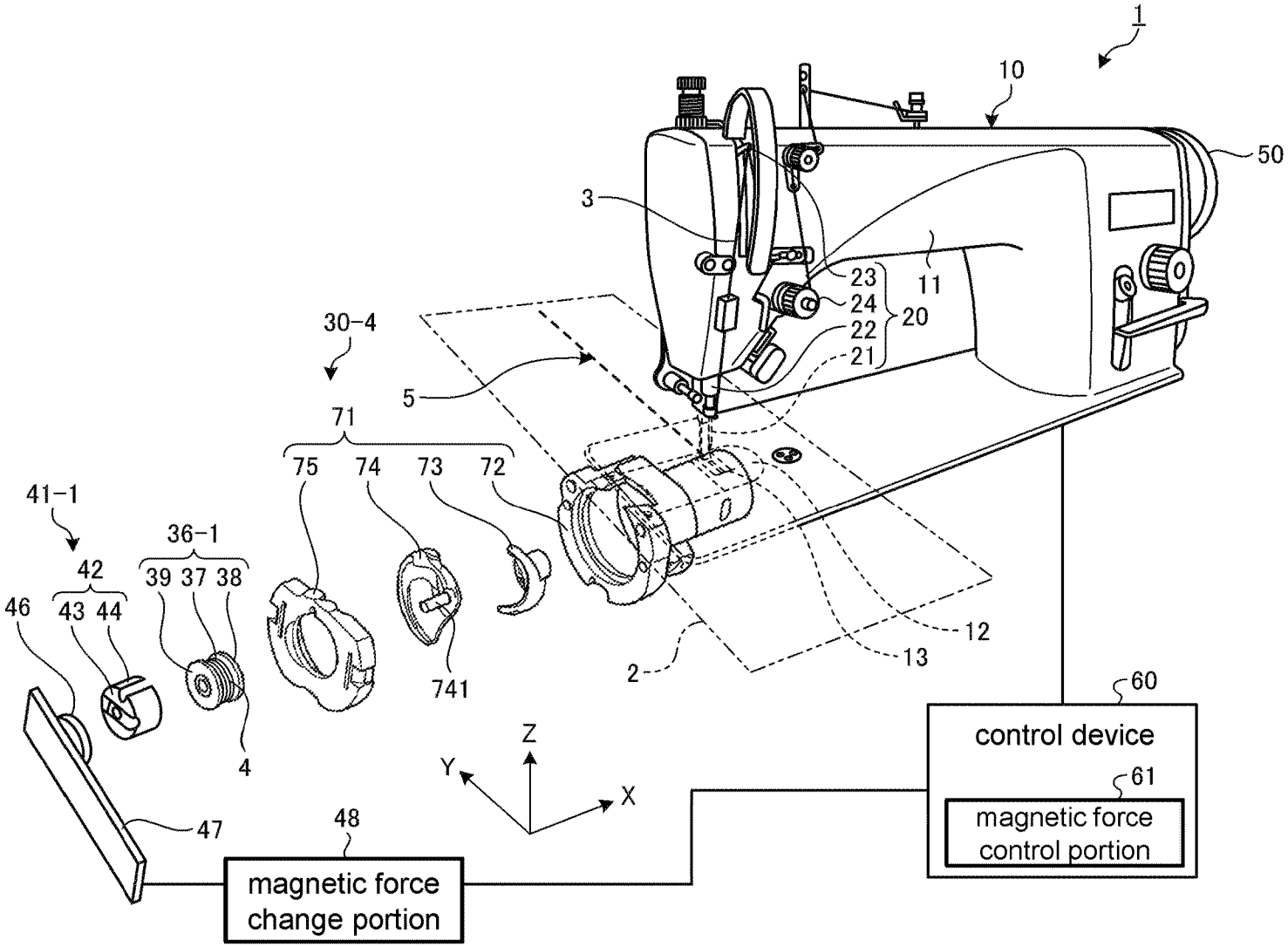

FIG. 14 is an exploded perspective view schematically showing an example of a lower thread supply device of a sewing machine according to a fourth embodiment.

DESCRIPTION OF THE EMBODIMENTS

Embodiments of the disclosure are described below with reference to the drawings, but the disclosure is not limited thereto. Structural components of the embodiments described below can be appropriately combined. In addition, a part of the structural components may not be used.

In the description below, an XYZ orthogonal coordinate system is set, and position relationships between each portion are described with reference to the XYZ orthogonal coordinate system. A direction parallel to an X-axis of a predetermined surface is an X-axis direction, a direction parallel to a Y-axis orthogonal to the X-axis in the predetermined surface is a Y-axis direction, and a direction parallel to a Z-axis orthogonal to the predetermined surface is a Z-axis direction.

First Embodiment

<Sewing Machine>

Figure 1:
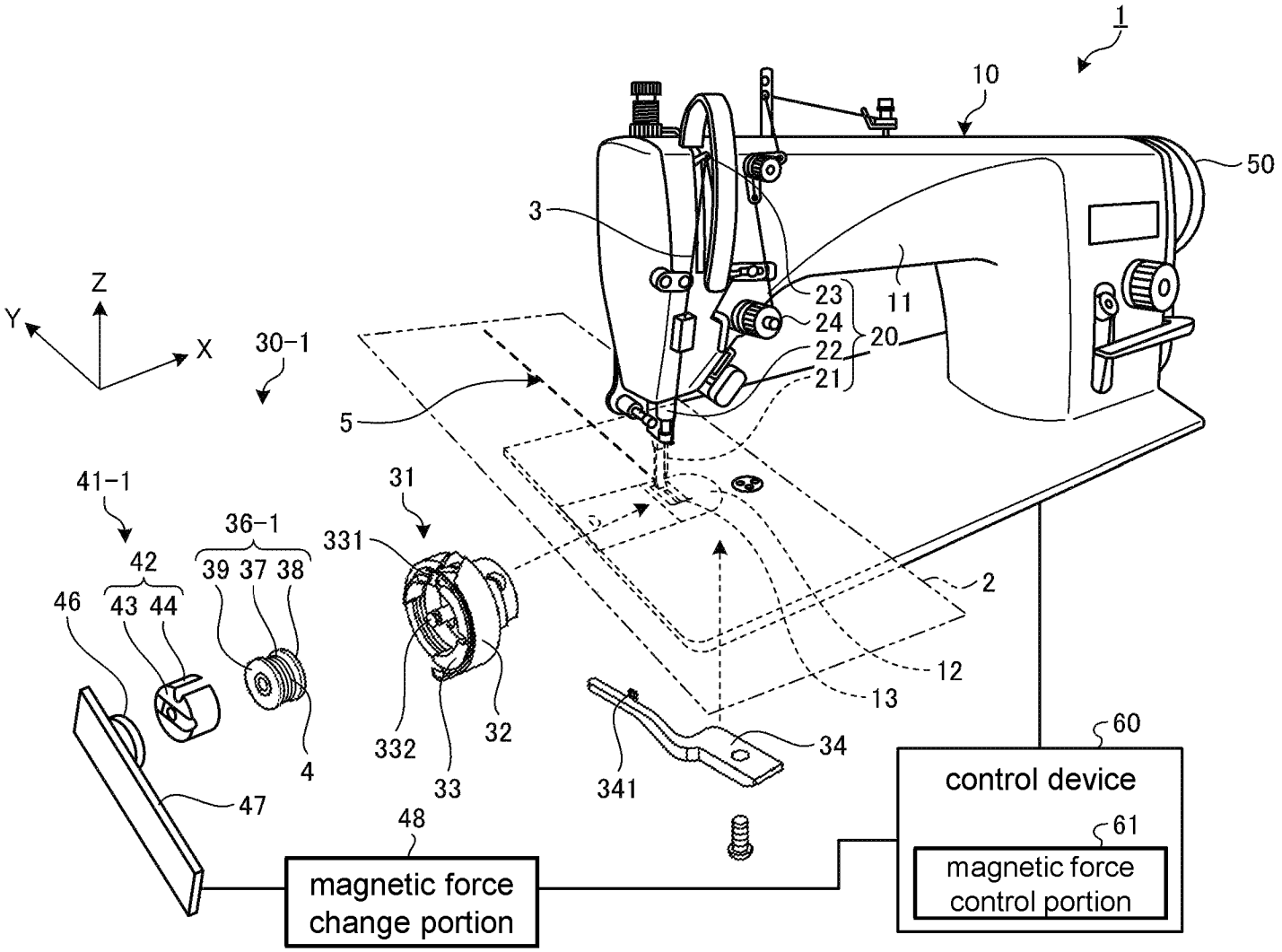
FIG. 1 is an exploded perspective view schematically showing an example of a lower thread supply device of a sewing machine according to a first embodiment.

FIG. 1 is an exploded perspective view schematically showing an example of a lower thread supply device of a sewing machine 30-1 according to a first embodiment. In the following, first, a sewing machine 1 including the lower thread supply device of a sewing machine 30-1 according to the first embodiment is described specifically using FIG. 1. In the embodiment, position relationships between each portion are described based on a local coordinate system defined by the sewing machine 1. The local coordinate system is defined by an XYZ orthogonal coordinate system as shown in FIG. 1. A direction parallel to an X-axis in a predetermined surface is an X-axis direction. A direction parallel to a Y-axis in the predetermined surface and orthogonal to the X-axis is a Y-axis direction. A direction parallel to a Z-axis orthogonal to the predetermined surface is a Z-axis direction. In addition, in the embodiment, a plane including the X-axis and the Y-axis is appropriately referred to as an XY-plane. A plane including the X-axis and the Z-axis is appropriately referred to as an XZ-plane. A plane including the Y-axis and Z-axis is appropriately referred to as a YZ-plane. The XY-plane is parallel to the predetermined surface. The XY-plane, the XZ-plane, and the YZ-plane are orthogonal to each other. In addition, in the embodiment, the XY-plane is parallel to the horizontal plane. A +X direction is a direction in which a bobbin 36-1 and a bobbin case 41-1 are stored in a shuttle 31, that is, a shuttle shaft side (shuttle side) direction. A −X direction is an opening direction of the shuttle 31, that is, a shuttle front surface side (front surface side) direction. A +Y direction is a feed direction of a sewing object 2 of the sewing machine 1. The Z-axis direction is a vertical direction. A +Z direction is an upward direction, and a −Z direction is a downward direction. Moreover, the XY-plane may be inclined with respect to the horizontal plane.

As shown in FIG. 1, the sewing machine 1 includes a sewing machine body 10, an upper thread supply device of a sewing machine 20, the lower thread supply device of a sewing machine 30-1 according to the first embodiment, a motor 50, and a control device 60, and sews the sewing object 2 by an upper thread 3 supplied from the upper thread supply device of a sewing machine 20 and a lower thread 4 supplied from the lower thread supply device of a sewing machine 30-1 to formed a seam 5 in the sewing object 2.

The sewing machine body 10 includes each component supporting each component of the upper thread supply device of a sewing machine 20 and each component of the lower thread supply device of a sewing machine 30-1 according to the first embodiment, that is, the sewing machine body 10 includes a sewing machine head 11, a needle plate 12, and a pressing member 13. The upper thread supply device of a sewing machine 20 includes each component arranged in a path through which the upper thread 3 passes, that is, the upper thread supply device 20 includes a sewing needle 21, a needle bar 22, a balance 23, and an upper thread tensioner 24.

The needle bar 22 holds the sewing needle 21 to make the sewing needle 21 parallel to the Z-axis and reciprocates in the Z-axis direction. The needle bar 22 is supported by the sewing machine head 11. The needle bar 22 is arranged above the needle plate 12 and may face a surface of the sewing object 2.

The sewing needle 21 is hooked with the upper thread 3 and has a threading hole through which the upper thread 3 passes. The sewing needle 21 holds the upper thread 3 on an inner surface of the threading hole. The needle bar 22 reciprocates in the Z-axis direction, and thereby the sewing needle 21 reciprocates in the Z-axis direction in a state of holding the upper thread 3.

The balance 23 supplies the upper thread 3 to the sewing needle 21 and is supported by the sewing machine head 11. The balance 23 has a balance hole through which the upper thread 3 passes. The balance 23 holds the upper thread 3 on an inner surface of the balance hole. The balance 23 operates in conjunction with the needle bar 22 and reciprocates in the Z-axis direction in a state of holding the upper thread 3. The balance 23 feeds or lifts the upper thread 3 by reciprocating in the Z-axis direction.

The upper thread tensioner 24 applies tension to the upper thread 3. The upper thread tensioner 24 is supported by the sewing machine head 11 and the upper thread 3 is supplied to the upper thread tensioner 24 from an upper thread supply source. In the path which is formed outside the sewing machine head 11 and through which the upper thread 3 passes, the balance 23 is arranged on an upstream side closer to the upper thread supply source than the sewing needle 21, and the upper thread tensioner 24 is arranged on an upstream side of the balance 23. The upper thread tensioner 24 adjusts the tension of the upper thread 3 supplied to the sewing needle 21 via the balance 23.

The needle plate 12 supports a back surface of the sewing object 2 from below at a sewing position where the sewing object 2 is sewed. The needle plate 12 faces the needle bar 22 and the sewing needle 21 held by the needle bar 22 in the Z-axis direction. The needle plate 12 has a needle hole through which the sewing needle 21 may pass. The needle hole of the needle plate 12 may be passed by the sewing needle 21 penetrating the sewing object 2 supported by the needle plate 12.

The pressing member 13 presses the sewing object 2 from above. The pressing member 13 is supported by the sewing machine head 11. The pressing member 13 is arranged above the needle plate 12 and is in contact with the surface of the sewing object 2. The pressing member 13 holds the sewing object 2 between the pressing member 13 and the needle plate 12.

The motor 50 generates power and has a stator supported by the sewing machine head 11 and a rotor rotably supported by the stator. The motor 50 generates power by rotation of the rotor. The power generated by the motor 50 is transmitted, via a power transmission mechanism (not shown), respectively to the needle bar 22, the balance 23, and the shuttle 31 described later which is arranged below the needle plate 12. The needle bar 22, the balance 23, and the shuttle 31 operate in conjunction. By the transmission of the power generated by the motor 50 to the needle bar 22, the needle bar 22 and the sewing needle 21 held by the needle bar 22 reciprocate in the Z-axis direction. By the transmission of the power generated by the motor 50 to the balance 23, the balance 23 reciprocates in the Z-axis direction in conjunction with the needle bar 22. By the transmission of the power generated by the motor 50 to the shuttle 31, the shuttle 31 reciprocates around the X-axis in conjunction with the needle bar 22 and the balance 23. The sewing machine 1 sews the sewing object 2 by cooperation of the sewing needle 21 held by the needle bar 22 and the shuttle 31.

In the description below, the rotation of the rotor is referred to as the rotation of the motor 50. The sewing needle 21 reciprocates due to the rotation of the motor 50. The balance 23 reciprocates in conjunction with the sewing needle 21 due to the rotation of the motor 50. The shuttle 31 reciprocates in conjunction with the sewing needle 21 and the balance 23 due to the rotation of the motor 50.

The upper thread 3 from the upper thread supply source is hooked on the sewing needle 21 via the balance 23 after the upper thread 3 is hooked on the upper thread tensioner 24. If the motor 50 rotates and the needle bar 22 descends, the sewing needle 21 held by the needle bar 22 penetrates the sewing object 2 and passes through the needle hole arranged in the needle plate 12. If the sewing needle 21 passes through the needle hole of the needle plate 12, the lower thread 4 supplied from the shuttle 31 is hooked to the upper thread 3 hooked on the sewing needle 21. In the state that the lower thread 4 is hooked on the upper thread 3, the sewing needle 21 rises and retreats from the sewing object 2. When the sewing needle 21 penetrates the sewing object 2, the sewing machine 1 stops the sewing object 2. When the sewing needle 21 retreats from the sewing object 2, the sewing machine 1 moves the sewing object 2 along the +Y direction. The sewing machine 1 repeatedly moves and stops the sewing object 2 in the +Y direction and makes the sewing needle 21 reciprocate to form the seam 5 in the sewing object 2. The seam 5 formed in the sewing object 2 extends along the Y-axis direction.

The control device 60 includes a computer system controlling the sewing machine 1 and the lower thread supply device of a sewing machine 30-1 according to the first embodiment. The control device 60 has a processing device (not shown) including a microprocessor such as a CPU (Central Processing Unit), a storage device (not shown) including a ROM (Read Only Memory) or a non-volatile memory such as a storage and a volatile memory such as a RAM (Random Access Memory), and an input/output interface (not shown) including an input/output circuit capable of inputting/outputting signals and data.

The processing device of the control device 60 executes various computer processing for controlling the sewing machine 1 and the lower thread supply device of a sewing machine 30-1 according to the first embodiment. The processing device of the control device 60 has a magnetic force control portion 61 controlling a magnetic force change portion 48 (described later) included in the lower thread supply device of a sewing machine 30-1 according to the first embodiment. The magnetic force control portion 61 controls the tension of the lower thread 4 supplied by the lower thread supply device of a sewing machine 30-1 by controlling the magnetic force change portion 48. The magnetic force control portion 61 is a function portion achieved by executing a lower thread tension control program by which the lower thread supply device of a sewing machine 30-1 according to the first embodiment controls the tension of the lower thread 4. The lower thread supply device of a sewing machine 30-1 according to the first embodiment functions as a lower thread tension control device of a sewing machine by further including the magnetic force control portion 61.

In the storage device of the control device 60, various information necessary for the computer processing executed by the processing device of the control device 60 is stored. In the storage device of the control device 60, for example, information on a correlative relationship between a magnetic force of the magnetic force change portion 48 and the tension of the lower thread 4 is stored. To the input/output interface of the control device 60, each device such as an input device (not shown) or the like necessary for obtaining the various information necessary for the computer processing executed by the processing device of the control device 60 and each device to be controlled by the control device 60, such as the motor 50 controlling the sewing processing of the sewing object 2, are connected.

<Lower Thread Supply Device of a Sewing Machine>

The lower thread supply device of a sewing machine 30-1 according to the first embodiment includes, as shown in FIG. 1, each component arranged on the path through which the lower thread 4 passes, that is, includes the shuttle 31, the bobbin 36-1, the bobbin case 41-1, a magnetic force member 46, a magnetic force member support portion 47, and the magnetic force change portion 48. The lower thread supply device of a sewing machine 30-1 according to the first embodiment is a device supplying the lower thread 4 from the shuttle 31 which is a full rotation shuttle.

Figure 2:
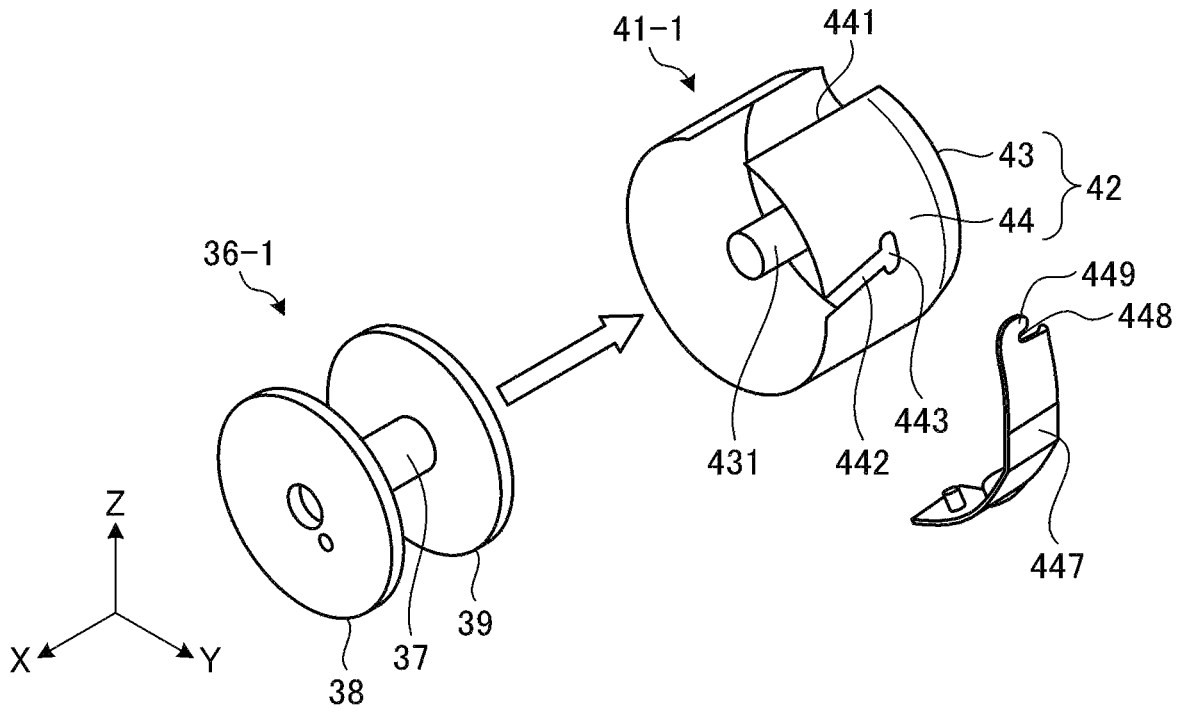
FIG. 2 is an exploded perspective view showing an example of a bobbin and a bobbin case according to the first embodiment.
Figure 3:
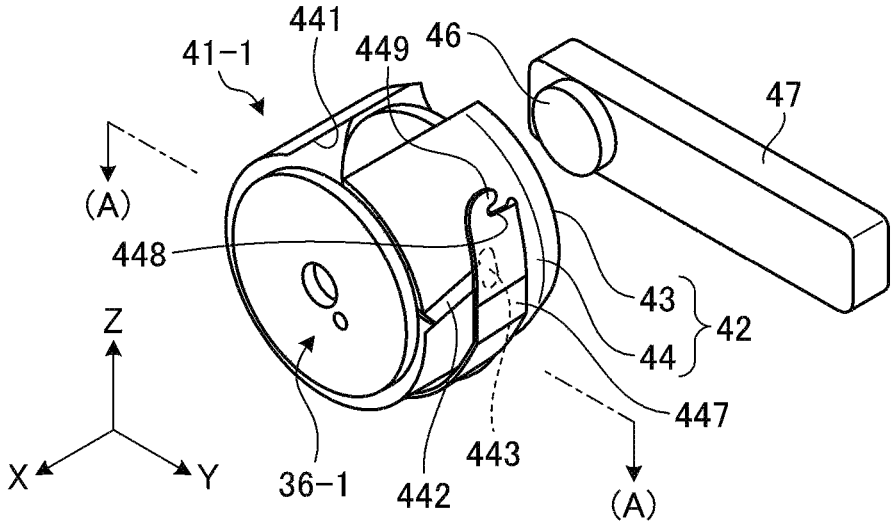
FIG. 3 is a perspective view showing an example of the bobbin, the bobbin case and a magnetic force member according to the first embodiment.

FIG. 2 is an exploded perspective view showing an example of the bobbin 36-1 and the bobbin case 41-1 according to the first embodiment. FIG. 3 is a perspective view showing an example of the bobbin 36-1, the bobbin case 41-1 and the magnetic force member 46 according to the first embodiment. In the following, the lower thread supply device of a sewing machine 30-1 according to the first embodiment is described specifically using FIG. 1, FIG. 2 and FIG. 3.

As shown in FIG. 1, the shuttle 31 is arranged below the needle plate 12 and houses the bobbin case 41-1 and the bobbin 36-1 housed by the bobbin case 41-1. The shuttle 31 is a so-called full rotation shuttle and has an outer shuttle 32, an inner shuttle 33, and a rotation prevention member 34.

The outer shuttle 32 is fixedly attached below the needle plate 12 and has a shuttle opening which opens in the −X direction. The inner shuttle 33 is inserted and attached to the outer shuttle 32 from the shuttle opening in the +X direction. The outer shuttle 32 is fixed to a shuttle shaft arranged in the +X direction of the outer shuttle 32 below the needle plate 12 and is applied with rotation from the shuttle shaft so as to be rotatable around the X-axis.

The outer shuttle 32 has a storage portion for storing and holding the inner shuttle 33 on a shuttle front surface side. The outer shuttle 32 has a loose fitting mechanism in the storage portion of the inner shuttle 33 for loosely fitting the inner shuttle 33 coaxially with the shuttle shaft. The outer shuttle 32 may be rotated by the loose fitting mechanism without rotating the inner shuttle 33.

The outer shuttle 32 has a point on a part of an outer circumference for scooping a loop of the upper thread 3 from the sewing needle 21 toward a rotation direction. The sewing machine 1 forms the seam 5 in a manner of scooping the loop of the upper thread 3 from the sewing needle 21 from below the needle plate 12 by the point of the outer shuttle 32 and entangling the loop of the upper thread 3 and the lower thread 4 supplied from the bobbin 36-1 described later.

The inner shuttle 33 is loosely fitted coaxially with the shuttle shaft inside the outer shuttle 32. The inner shuttle 33 has a storage portion storing and holding the bobbin 36-1 and the bobbin case 41-1 at the shuttle front surface side. The inner shuttle 33 has an opening at the shuttle front surface side of the storage portion. Through the opening, the inner shuttle 33 may insert the bobbin 36-1 and the bobbin case 41-1 into the storage portion of the inner shuttle 33 or take out the bobbin 36-1 and the bobbin case 41-1 stored in the storage portion of the inner shuttle 33.

The inner shuttle 33 has a spindle 332 which is erected in the storage portion of the bobbin 36-1 and the bobbin case 41-1 in the −X direction toward the shuttle front surface side and which supports the bobbin 36-1 and the bobbin case 41-1. The spindle 332 is positioned at a center of rotation of the outer shuttle 32 and is concentric with the shuttle shaft when the inner shuttle 33 is housed in the outer shuttle 32. The spindle 332 has a circumferential groove arranged at a distal end portion around an outer circumference. The circumferential groove of the spindle 332 can be fitted with an inner edge of an opening at a center of a latch lever described later.

The inner shuttle 33 has, in a region at the +Z direction side of the outer circumference, that is, a region facing the needle plate 12 in the Z-axis direction, a concave portion 331 formed in an end portion at the shuttle front surface side. A convex portion 341 (described later) of the rotation prevention member 34 is fitted into the concave portion 331, and thereby the inner shuttle 33 prevents rotation caused by the rotation of the outer shuttle 32 rotation prevention member.

The rotation prevention member 34 is a member formed extending in the Y-axis direction and is fixed and arranged below the needle plate 12. An end portion of the rotation prevention member 34 in the −Y direction is attached to and supported by a bottom plate part of the sewing machine head 11 from below. The rotation prevention member 34 has the convex portion 341 projecting in the +Z direction at an end portion in the +Y direction. By the convex portion 341 being fitted into the concave portion 331 of the inner shuttle 33, the rotation prevention member 34 prevents the inner shuttle 33 from rotating due to the rotation of the outer shuttle 32 and enables an operation of the shuttle 31, that is, the inner shuttle 33 does not rotate and the outer shuttle 32 rotates.

The spindle 332 may be non-magnetic, that is, formed of a non-magnetic material; in this case, an attraction force of the magnetic force member 46 described later for the inner shuttle 33 can be reduced to about one-third as compared with a case where the spindle 332 is magnetic. Accordingly, an attraction force of the magnetic force member 46 for a front surface side flange portion 39 of the bobbin 36-1 can be improved to about twice as compared with a case where the spindle 332 is magnetic.

As shown in FIG. 1 and FIG. 2, the bobbin 36-1 has a cylindrical portion 37, a shuttle side flange portion 38, and the front surface side flange portion 39. The spindle 332 shown in FIG. 1 is inserted into the cylindrical portion 37 via insertion of a shaft cylindrical portion 431 shown in FIG. 2. The bobbin 36-1 is rotatably supported by the spindle 332 at a loosely fitting state.

The shuttle side flange portion 38 is formed at a shuttle side which is a side facing the shuttle 31 in the cylindrical portion 37, that is, an end portion at the shuttle shaft side. The front surface side flange portion 39 is formed at a front surface side of the shuttle 31 which is a side opposite to the side facing the shuttle 31 in the cylindrical portion 37, that is, the end portion at the shuttle front surface side. The bobbin 36-1 becomes a lower thread supply source for the shuttle 31 in manner that the lower thread 4 is wound around an outer circumference of the cylindrical portion 37 between the shuttle side flange portion 38 and the front surface side flange portion 39. The bobbin 36-1 unwinds the lower thread 4 by rotating the cylindrical portion 37 around the axis (around the X-axis) in a direction opposite to the winding direction of the lower thread 4.

In the bobbin 36-1, at least the front surface side flange portion 39 is magnetic, that is, is formed by a magnetic material. On the other hand, in the bobbin 36-1, both the cylindrical portion 37 and the shuttle side flange portion 38 may be magnetic or may not be magnetic. In the bobbin 36-1, when the cylindrical portion 37, the shuttle side flange portion 38 and the front surface side flange portion 39 are all magnetic, they may be formed integrally by a magnetism material.

The bobbin case 41-1 has a non-magnetic cover portion 42 housing the bobbin 36-1 and transmitting a magnetic force. The cover portion 42 has, as shown in FIG. 1, FIG. 2 and FIG. 3, a front surface side part 43 covering the front surface side of the bobbin 36-1 and the side wall part 44 covering the outer circumference side of the bobbin 36-1.

As shown in FIG. 2, the front surface side part 43 has the shaft cylindrical portion 431 erected on a surface at the side facing the shuttle 31, that is, the shuttle shaft side. The shaft cylindrical portion 431 is inserted into the cylindrical portion 37 of the bobbin 36-1, and the spindle 332 of the inner shuttle 33 is inserted into the shaft cylindrical portion 431. That is, for the shaft cylindrical portion 431, the cylindrical portion 37 of the bobbin 36-1 is arranged at the outer circumference side in a loosely fitting state, and the spindle 332 of the inner shuttle 33 is arranged at an inner circumference side.

As shown in FIG. 1, the front surface side part 43 has the latch lever engaged with the spindle 332 of the inner shuttle 33 inserted into the shaft cylindrical portion 431 at the side opposite to the side facing the shuttle 31, that is, the shuttle front surface side. The latch lever has an opening communicating with the shaft cylindrical portion 431 at the center. The latch lever may be rotated raised and lowered with respect to the front surface side part 43. The distal end portion of the spindle 332 can be loosely inserted into the opening in the center of the latch lever in a prone state of the latch lever, and the falling of the bobbin case 41-1 from the spindle 332 can be prevented by fitting an inner edge of the opening of the center of the latch lever into the circumferential groove of the spindle 332.

As shown in FIG. 2 and FIG. 3, the front surface side part 43 has an arc-shaped chipped portion at a position corresponding to a sewing needle reception region 441 described later. In the arc-shaped chipped portion, one end portion of the arc is arranged matching one end portion of the sewing needle reception region 441, and the other end portion of the arc is arranged matching the other end portion of the sewing needle reception region 441.

As shown in FIG. 2 and FIG. 3, the side wall part 44 has the sewing needle reception region 441 which is a region for receiving the insertion of the sewing needle 21 of the sewing machine 1. The sewing needle reception region 441 is a gap arranged along a circumferential direction in the side wall part 44, and both ends of the gap are arranged linearly along the X-axis direction. The sewing needle reception region 441 is a region for receiving the distal end of the sewing needle 21 penetrating the sewing object 2 and passing through the needle hole arranged in the needle plate 12 as the needle bar 22 descends, and the sewing needle reception region 441 can prevent interference between the side wall part 44 and the distal end of the sewing needle 21.

As shown in FIG. 2 and FIG. 3, the side wall part 44 has a first slit 442 which is cut from the shuttle side (the shuttle shaft side) toward the front surface side (the shuttle front surface side). The first slit 442 has a thread feeding hole 443 in the distal end at the front surface side (the shuttle front surface side). The first slit 442 receives the insertion of the lower thread 4 and guides the inserted lower thread 4 to the thread feeding hole 443. The thread feeding hole 443 is a hole for feeding the lower thread 4 from the inside of the bobbin case 41-1 to the outside. The first slit 442 may be arranged passing through the outer circumference of the side wall part 44 from the thread feeding hole 443 to be inclined in an upward direction. In this case, the lower thread 4 can be smoothly guided upward from the thread feeding hole 443.

In addition, in the side wall part 44, a leaf spring 447 is attached to cover a distal end side of the first slit 442. In a distal end portion of the leaf spring 447, a lead-out portion 448 is formed which leads the lower thread 4 to the outside and holds a lead-out position of the lower thread 4. As shown in FIG. 2 and FIG. 3, a claw piece 449 for holding the lower thread 4 is formed at a distal end at the side of the leaf spring 447 where the lead-out portion 448 is formed, and the lower thread 4 led out to the lead-out portion 448 does not slip off from the leaf spring 447. The lower thread 4 fed from the thread feeding hole 443 is inserted below the leaf spring 447 while following the side wall part 44 of the bobbin case and is further guided by the lead-out portion 448.

As shown in FIG. 1 and FIG. 3, the magnetic force member 46 is arranged at the front surface side of the bobbin case 41-1, that is, the shuttle front surface side. The magnetic force member 46 attracts, by a magnetic force, the front surface side flange portion 39 of the bobbin 36-1 being magnetic through the non-magnetic bobbin case 41-1. The magnetic force member 46 is supported by the magnetic force member support portion 47. The magnetic force member 46 changes the attraction force of the front surface side flange portion 39 by changing the magnetic force with the magnetic force change portion 48 shown in FIG. 1.

(A) and (B) of FIG. 4 are schematic diagrams showing a first example of the bobbin 36-1, the bobbin case 41-1 and the magnetic force member 46 according to the first embodiment. (A) and (B) of FIG. 5 are a schematic diagrams showing a second example of the bobbin 36-1, the bobbin case 41-1 and the magnetic force member 46 according to the first embodiment. (A) and (B) of FIG. 4 and (A) and (B) of FIG. 5 are cross-section views along an A-A cross section in FIG. 3, that is, cross-section views in the XY-plane. In (A) and (B) of FIG. 4 and (A) and (B) of FIG. 5, the lower thread 4 and the magnetic force member support portion 47 are omitted. In the following, examples of the bobbin 36-1, the bobbin case 41-1 and the magnetic force member 46 according to the first embodiment are specifically described using (A) and (B) of FIG. 4 and (A) and (B) of FIG. 5.

The first example of the lower thread supply device of a sewing machine 30-1 according to the first embodiment has a form in which, as shown in (A) and (B) of FIG. 4, the magnetic force member 46 is a magnet 46-1 and the magnetic force change portion 48 is a drive portion 48-1 which relatively moves the magnet 46-1 with respect to the front surface side flange portion 39.

In the first example, as shown in (A) of FIG. 4, the drive portion 48-1 moves the magnet 46-1 relatively close to the front surface side flange portion 39, and thereby an attraction force of the magnet 46-1 to the front surface side flange portion 39 increases. Thereby, a force by which the front surface side flange portion 39 is pressed to the shuttle side (the shuttle shaft side) of the front surface side part 43 of the bobbin case 41-1 increases, and thus a frictional force generated between the front surface side flange portion 39 and the front surface side part 43, and resistance to the rotation of the bobbin 36-1 inside the bobbin case 41-1, that is, rotation resistance of the bobbin 36-1 increases. Accordingly, in the lower thread 4 wound around the bobbin 36-1 and supplied from the bobbin 36-1, a force at which the lower thread 4 is pulled by the bobbin 36-1 increases with the increase in the rotation resistance of the bobbin 36-1, and thus the tension increases.

On the other hand, in the first example, as shown in (B) of FIG. 4, the drive portion 48-1 relatively moves the magnet 46-1 away from the front surface side flange portion 39, and thereby the attraction force of the magnet 46-1 to the front surface side flange portion 39 decreases. Thereby, a force by which the front surface side flange portion 39 is pressed to the shuttle side (the shuttle shaft side) of the front surface side part 43 of the bobbin case 41-1 decreases, and thus the frictional force generated between the front surface side flange portion 39 and the front surface side part 43 decreases, and the resistance to the rotation of the bobbin 36-1 inside the bobbin case 41-1, that is, the rotation resistance of the bobbin 36-1 decreases. Accordingly, in the lower thread 4 wound around the bobbin 36-1 and supplied from the bobbin 36-1, the force at which the lower thread 4 is pulled by the bobbin 36-1 decreases with the decrease in the rotation resistance of the bobbin 36-1, and thus the tension decreases.

A second example of the lower thread supply device of a sewing machine 30-1 according to the first embodiment has a form in which, as shown in (A) and (B) of FIG. 5, the magnetic force member 46 is an electromagnet 46-2 and the magnetic force change portion 48 is a power supply portion 48-2 which changes a current applied to the electromagnet 46-2.

In the second example, as shown in (A) of FIG. 5, the power supply portion 48-2 increases the current applied to the electromagnet 46-2, and thereby an attraction force of the electromagnet 46-2 to the front surface side flange portion 39 increases. Accordingly, a force by which the front surface side flange portion 39 is pressed to the shuttle side (the shuttle shaft side) of the front surface side part 43 of the bobbin case 41-1 increases, and thus the tension of the lower thread 4 wound around the bobbin 36-1 and supplied from the bobbin 36-1 then increases by the same mechanism as in the first example.

On the other hand, in the second example, as shown in (B) of FIG. 5, the power supply portion 48-2 decreases the current applied to the electromagnet 46-2, and thereby the attraction force of the electromagnet 46-2 to the front surface side flange portion 39 decreases. Accordingly, the force by which the front surface side flange portion 39 is pressed to the shuttle side (the shuttle shaft side) of the front surface side part 43 of the bobbin case 41-1 decreases, and thus the tension of the lower thread 4 wound around the bobbin 36-1 and supplied from the bobbin 36-1 then decreases by the same mechanism as in the first example.

In addition, regardless of which of the magnet 46-1 and the electromagnet 46-2 is used, when the sewing machine 1 is stopped or the lower thread 4 is cut, the magnetic force member 46 can attract the front surface side flange portion 39 by the magnetic force to be capable of giving resistance to the rotation of the bobbin 36-1 inside the bobbin case 41-1, and thus the bobbin 36-1 around which the lower thread 4 has been wound can be prevented from idle running. Conventionally, a bobbin is always pressed with a slight force by a spring arranged inside a bobbin case to thereby prevent the bobbin from idle running; however, the magnetic force member 46 according to the first embodiment can also function as a substitute for the spring arranged inside the bobbin case.

FIG. 6 is an illustration diagram illustrating a position of the thread feeding hole 443 according to the first embodiment. Similar to (A) and (B) of FIG. 4 and (A) and (B) of FIG. 5, FIG. 6 is a cross-section view along the A-A cross section in FIG. 3, that is, a cross-section view in the XY-plane. In FIG. 6, the magnetic force member 46, the magnetic force member support portion 47 and the magnetic force change portion 48 are omitted. As shown in FIG. 6, the thread feeding hole 443 may be arranged at a position in the side wall part 44 facing an axial central portion of the cylindrical portion 37.

A change angle showing change in the direction of the lower thread 4 in the thread feeding hole 443 when the lower thread 4 is fed from the thread feeding hole 443 is determined by the winding amount of the lower thread 4, the supply position of the lower thread 4, and the position of the thread feeding hole 443. Here, the winding amount of the lower thread 4 is an amount of the lower thread 4 wound around the cylindrical portion 37 and is represented by, for example, the maximum diameter of the lower thread 4 wound around the cylindrical portion 37. The supply position of the lower thread 4 is a position where the lower thread 4 wound around the cylindrical portion 37 is unwound and is represented by, for example, a distance from the shuttle side flange portion 38 or the front surface side flange portion 39 in the cylindrical portion 37.

When the thread feeding hole 443 is arranged at a position shown in FIG. 6, for example, when winding amounts of the lower thread 4 are the same, a change angle θ1 when the lower thread 4 is unwound from the end portion at the side of the front surface side flange portion 39 in the cylindrical portion 37 as shown in the left in FIG. 6 and a change angle θ3 when the lower thread 4 is unwound from the end portion at the side of the shuttle side flange portion 38 in the cylindrical portion 37 as shown in the right in FIG. 6 have the same value and both take the maximum value. In addition, in the same case, a change angle θ2 when the lower thread 4 is unwound from the axial central portion in the cylindrical portion 37 becomes 0 and takes the minimum value. Accordingly, when the thread feeding hole 443 is arranged at the position shown in FIG. 6, the maximum value of the change angle representing the change in the direction of the lower thread 4 in the thread feeding hole 443 can be suitably reduced, and the width of a range in which the change angle can be obtained can also be suitably reduced, and thus variation in the tension of the lower thread 4 wound around the bobbin 36-1 and supplied from the bobbin 36-1 can be minimized.

As shown in the above description, according to the embodiment, by using the magnetic force member 46 to apply the force for pressing the front surface side flange portion 39 being magnetic to the shuttle side (the shuttle shaft side) of the front surface side part 43 of the bobbin case 41-1, the frictional force generated between the front surface side flange portion 39 and the front surface side part 43 increases, and the resistance to the rotation of the bobbin 36-1 inside the bobbin case 41-1, that is, the rotation resistance of the bobbin 36-1 increases, and thereby the force for pulling the lower thread 4 by the bobbin 36-1 can be applied, and the tension can be applied to the lower thread 4. In addition, the magnetic force acting on the front surface side flange portion 39 of the magnetic force member 46 can be changed by the magnetic force change portion 48, and thus the tension of the lower thread 4 can be changed easily without troublesome work such as removing the conventional bobbin case and bobbin from the shuttle and changing the screwing amount of a tension adjustment screw.

In addition, according to the embodiment, the first example has the form in which the magnetic force member 46 is the magnet 46-1 and the magnetic force change portion 48 is the drive portion 48-1 which relatively moves the magnet 46-1 with respect to the front surface side flange portion 39. Therefore, by relatively moving the magnet 46-1 by the drive portion 48-1 with respect to the front surface side flange portion 39, the tension of the lower thread 4 can be easily changed.

In addition, according to the embodiment, the second example has the form in which the magnetic force member 46 is the electromagnet 46-2 and the magnetic force change portion 48 is the power supply portion 48-2 which changes the current applied to the electromagnet 46-2. Therefore, by changing the current applied to the electromagnet 46-2 by the power supply portion 48-2, the tension of the lower thread 4 can be easily changed.

In addition, according to the embodiment, the bobbin case 41-1 further includes the thread feeding hole 443 which is arranged at the position in the side wall part 44 facing the axial central portion of the cylindrical portion 37 and is configured for feeding the lower thread 4 from the inside to the outside. Therefore, the maximum value of the change angle representing the change in the direction of the lower thread 4 in the thread feeding hole 443 can be suitably reduced, and the width of the range in which the change angle can be obtained can also be suitably reduced, and thus the variation of the tension of the lower thread 4 wound around the bobbin 36-1 and supplied from the bobbin 36-1 can be minimized.

Second Embodiment

A second embodiment is described. In the description below, structural components the same as that in the above embodiment are denoted by the same symbols, and description thereof is simplified or omitted.

<Lower Thread Supply Device of Sewing Machine>

FIG. 7 is a perspective view showing an example of a bobbin case 41-2 in a lower thread supply device of a sewing machine 30-2 according to the second embodiment. FIG. 8 is a schematic diagram showing an example of a bobbin 36-2, the bobbin case 41-2 and a magnetic force member 46 according to the second embodiment. FIG. 7 is a view of the bobbin case 41-2 taken substantially from the shuttle side (the shuttle shaft side). FIG. 8 is a cross-section view similar to (A) and (B) of FIG. 4, (A) and (B) of FIG. 5 and FIG. 6 and a cross-section view in the XY-plane.

The lower thread supply device of a sewing machine 30-2 according to the second embodiment is obtained by changing the bobbin case 41-1 to the bobbin case 41-2 and changing the bobbin 36-1 to the bobbin 36-2 in the lower thread supply device of a sewing machine 30-1 according to the first embodiment, and other configurations are the same.

As shown in FIG. 8, the bobbin 36-2 is obtained by respectively adding taper portions 381 and 391 to the flange portions at both sides in the bobbin 36-1.

As shown in FIG. 8, the bobbin 36-2 has the taper portion 391 which is inclined toward the shuttle side (the shuttle shaft side) at an outer circumference portion of the front surface side flange portion 39. Because the bobbin 36-2 has the taper portion 391 inclined toward the shuttle side (the shuttle shaft side), possibility of the distal end of the sewing needle 21 interfering with the outer circumference portion of the front surface side flange portion 39 can be reduced, the bobbin 36-2 penetrating the sewing object 2 and passing through the needle hole arranged in the needle plate 12 as the needle bar 22 descends.

The bobbin 36-2 has, in addition to the taper portion 391, the taper portion 381 which is inclined toward the front surface side (the shuttle front surface side) at an outer circumference portion of the shuttle side flange portion 38. Because the bobbin 36-2 has the taper portions 381 and 391 respectively in the flange portions at both sides, the bobbin 36-2 is symmetrical with respect to the axial central portion of the cylindrical portion 37 and can stabilize the rotation of the cylindrical portion 37 around the axis (around the X-axis).

As shown in FIG. 7, the bobbin case 41-2 is obtained by further adding a contact member 421 in the bobbin case 41-1. The contact member 421 is arranged on an inner surface of the cover portion 42 of the bobbin case 41-2 and is arranged in contact with the front surface side flange portion 39 of the bobbin 36-2 housed in the bobbin case 41-2.

Moreover, compared with the bobbin case 41-1 according to the first embodiment, in the bobbin case 41-2 shown in FIG. 7, positions where the first slit 442 and the thread feeding hole 443 are arranged are different; however, the first slit 442 and the thread feeding hole 443 may be arranged in the same positions as in the bobbin case 41-1 according to the first embodiment, or may be arranged in positions different from the positions shown in the FIG. 7 and the bobbin case 41-1 according to the first embodiment.

The contact member 421 is arranged in contact with the front surface side flange portion 39 of the bobbin 36-2, and thereby a contact area between the front surface side flange portion 39 and the bobbin case 41-2 when the front surface side flange portion 39 is attracted by the magnetic force of the magnetic force member 46 can be increased, and thus a frictional force between the front surface side flange portion 39 and the bobbin case 41-2 can be increased. Therefore, the contact member 421 functions as a lower thread supply resistance mechanism which further applies a resistance action to the supply operation of the lower thread 4 wound around the bobbin 36-2. By the contact member 421 functioning as the lower thread supply resistance mechanism in this way, a change amount of the tension of the lower thread 4 based on the change in the magnetic force determined by the magnetic force change portion 48 can be increased, the magnetic force acting on the front surface side flange portion 39 of the magnetic force member 46.

More specifically, as shown in FIG. 8, the contact member 421 is arranged in contact with the taper portion 391 in a region facing the taper portion 391 on the inner surface of the front surface side part 43 of the cover portion 42 in the bobbin case 41-2. More specifically, the contact member 421 is arranged in a connect region between the front surface side part 43 and the side wall part 44 on the inner surface of the cover portion 42 of the bobbin case 41-2. Therefore, the contact member 421 can increase, particularly in the taper portion 391, the contact area between the front surface side flange portion 39 and the bobbin case 41-2 when the front surface side flange portion 39 is attracted by the magnetic force of the magnetic force member 46, and thus the contact member 421 remarkably functions as the lower thread supply resistance mechanism for the bobbin 36-2 provided with the taper portion 391.

As shown in FIG. 7, the contact member 421 is arranged into an arc shape to avoid the sewing needle reception region 441 which receives the insertion of the sewing needle 21 of the sewing machine 1. Therefore, in the contact member 421, the possibility of interfering with the distal end of the sewing needle 21 which penetrates the sewing object 2 and passes through the needle hole arranged in the needle plate 12 as the needle bar 22 descends is reduced. In addition, by being arranged in this way, the contact member 421 can increase, in more regions of the taper portion 391, the contact area between the front surface side flange portion 39 and the bobbin case 41-2 when the front surface side flange portion 39 is attracted by the magnetic force of the magnetic force member 46. Therefore, the contact member 421 particularly remarkably functions as the lower thread supply resistance mechanism for the bobbin 36-2 provided with the taper portion 391.

Specifically, as the contact member 421, a contact member is suitably used in which a non-magnetic metal column (for example, a wire member) having a diameter large enough to just fill the space between the front surface side part 43 of the cover portion 42 of the bobbin case 41-2 and the taper portion 391 is curved along an inner circumference of the side wall part 44 in a manner of avoiding the sewing needle reception region 441.

As described above, according to the embodiment, in addition to the first embodiment, the bobbin case 41-2 further includes the contact member 421 functioning as the lower thread supply resistance mechanism which applies the resistance action to the supply operation of the lower thread 4 wound around the bobbin 36-2. Therefore, in addition to providing the same operational effects as the operational effects provided in the first embodiment, by the contact member 421 functioning as the lower thread supply resistance mechanism, the change amount of the tension of the lower thread 4 based on the change in the magnetic force determined by the magnetic force change portion 48 can be increased, the magnetic force acting on the front surface side flange portion 39 of the magnetic force member 46. Thereby, the change width of the tension of the lower thread 4 via the change of the magnetic force of the magnetic force member 46 determined by the magnetic force change portion 48 can be expanded.

In addition, according to the embodiment, the lower thread supply resistance mechanism is the contact member 421 which is arranged in contact with the bobbin 36-2 on the inner surface of the bobbin case 41-2. Therefore, the contact area between the front surface side flange portion 39 and the bobbin case 41-2 when the front surface side flange portion 39 is attracted by the magnetic force of the magnetic force member 46 can be increased by the contact member 421. Therefore, the frictional force between the front surface side flange portion 39 and the bobbin case 41-2 can be increased. Accordingly, the change amount of the tension of the lower thread 4 based on the change in the magnetic force determined by the magnetic force change portion 48 can be increased, the magnetic force acting on the front surface side flange portion 39 of the magnetic force member 46, and the change width of the tension of the lower thread 4 via the change in the magnetic force of the magnetic force member 46 determined by the magnetic force change portion 48 can be expanded.

In addition, according to the embodiment, the bobbin 36-2 further includes the taper portion 391 inclined toward the shuttle side in the outer circumference portion of the front surface side flange portion 39, and the contact member 421 arranged in the bobbin case 41-2 is arranged in contact with the taper portion 391 in the region facing the taper portion 391 on the inner surface of the front surface side part 43 in the cover portion 42. Therefore, the contact member 421 can increase, particularly in the taper portion 391, the contact area between the front surface side flange portion 39 and the bobbin case 41-2 when the front surface side flange portion 39 is attracted by the magnetic force of the magnetic force member 46. Therefore, the contact member 421 can remarkably increase the frictional force between the front surface side flange portion 39 and the bobbin case 41-2 for the bobbin 36-2 provided with the taper portion 391. In addition, by arranging the contact member 421 on the outer circumference side of the front surface side flange portion 39, stable contact is achieved and the contact area can be increased. Accordingly, when the bobbin 36-2 provided with the taper portion 391 is used, remarkably, the change amount of the tension of the lower thread 4 based on the change in the magnetic force determined by the magnetic force change portion 48 can be remarkably increased, the magnetic force acting on the front surface side flange portion 39 of the magnetic force member 46, and the change width of the tension of the lower thread 4 via the change of the magnetic force of the magnetic force member 46 determined by the magnetic force change portion 48 can be remarkably expanded.

In addition, according to the embodiment, the contact member 421 is further arranged into an arc shape to avoid the sewing needle reception region 441 which receives the insertion of the sewing needle 21 the sewing machine 1. Therefore, by the contact member 421, the possibility of interfering with the distal end of the sewing needle 21 is reduced, the sewing needle 21 penetrating the sewing object 2 and passing through the needle hole arranged in the needle plate 12 as the needle bar 22 descends. In addition, by the contact member 421, in more regions of the taper portion 391, the contact area between the front surface side flange portion 39 and the bobbin case 41-2 when the front surface side flange portion 39 is attracted by the magnetic force of the magnetic force member 46 can be increased. Therefore, for the bobbin 36-2 provided with the taper portion 391, the frictional force between the front surface side flange portion 39 and the bobbin case 41-2 can be particularly remarkably increased. Accordingly, when the bobbin 36-2 provided with the taper portion 391 is used, the change amount of the tension of the lower thread 4 based on the change in the magnetic force determined by the magnetic force change portion 48 can be particularly remarkably increased, the magnetic force acting on the front surface side flange portion 39 of the magnetic force member 46, and the change width of the tension of the lower thread 4 via the change of the magnetic force of the magnetic force member 46 determined by the magnetic force change portion 48 can be expanded.

Third Embodiment

A third embodiment is described. In the description below, structural components the same as that in the above embodiment are denoted by the same symbols, and description thereof is simplified or omitted.

<Lower Thread Supply Device of Sewing Machine>

FIG. 9 is an exploded perspective view showing an example of a bobbin 36-3 and a bobbin case 41-3 in a lower thread supply device of a sewing machine 30-3 according to the third embodiment. FIG. 10 is a perspective view showing an example of the bobbin case 41-3 according to the third embodiment. FIG. 11 is a plan view showing an example of the bobbin case 41-3 according to the third embodiment. FIG. 12 is a schematic diagram showing an example of the bobbin 36-3, the bobbin case 41-3 and the magnetic force member 46 according to the third embodiment. FIG. 9 and FIG. 10 are both perspective views taken from the same direction. FIG. 11 is almost the same as FIG. 7 and is a view of the bobbin case 41-3 taken from the shuttle side (the shuttle shaft side). FIG. 12 is a cross-section view the same as (A) and (B) of FIG. 4, (A) and (B) of FIG. 5, FIG. 6 and FIG. 8 and is a cross-section view in the XY-plane.

The lower thread supply device of a sewing machine 30-3 according to the third embodiment is obtained by changing the bobbin case 41-1 to the bobbin case 41-3 in the lower thread supply device of a sewing machine 30-1 according to the first embodiment, and other configurations are the same. Moreover, the bobbin 36-3 included in the lower thread supply device of a sewing machine 30-3 according to the third embodiment can appropriately use the bobbin 36-1 according to the first embodiment and the bobbin 36-2 according to the second embodiment. Therefore, hereinafter, the bobbin 36-3 is distinguished from the bobbin 36-1 according to the first embodiment and the bobbin 36-2 according to the second embodiment for convenience of description of the third embodiment.

As shown in FIG. 9, FIG. 10 and FIG. 11, the bobbin case 41-3 is obtained by further adding a second slit 444 in the side wall part 44 in addition to the sewing needle reception region 441, the first slit 442 and the thread feeding hole 443 the same as that of the bobbin case 41-1. The second slit 444 is cut along a circumferential direction in the side wall part 44. The second slit 444 receives the insertion of the lower thread 4 guided into the thread feeding hole 443 by the first slit 442 and guides the lower thread 4 to a gap portion between the front surface side part 43 of the bobbin case 41-3 and the front surface side flange portion 39 of the bobbin 36-3.

The second slit 444 is arranged in the bobbin case 41-3 and functions as a lower thread guiding mechanism which guides the lower thread 4 fed from the inside toward the outside to the gap portion between the front surface side part 43 and the front surface side flange portion 39. In the third embodiment, the second slit 444 is arranged as the lower thread guiding mechanism, but the disclosure is not limited hereto, and even a mechanism which guides the lower thread 4 to the gap portion between the front surface side part 43 and the front surface side flange portion 39 using another method is arranged, operational effects the same as that of the third embodiment can be expected.

As shown in FIG. 12, a part of the lower thread 4 guided to the gap portion by the second slit 444 is clamped between the front surface side flange portion 39 and the front surface side part 43 of the bobbin case 41-3 when the front surface side flange portion 39 is attracted by the magnetic force of the magnetic force member 46. Therefore, a frictional force is generated both between the lower thread 4 and the front surface side flange portion 39 and between the lower thread 4 and the front surface side part 43 of the bobbin case 41-3, and thus a resistance action is provided to a supply operation of the lower thread 4 wound around the bobbin 36-3. Therefore, the second slit 444 functions as the lower thread supply resistance mechanism. Moreover, even when another lower thread guiding mechanism is employed, the lower thread guiding mechanism also functions as a lower thread supply resistance mechanism the same as the second slit 444 according to the third embodiment.

As shown in FIG. 10 and FIG. 11, the second slit 444 guides the lower thread 4 to the gap portion in a straight line connecting one end portion and the other end portion of the second slit 444, that is, a chord shape when the side wall part 44 is regarded as a column. Based on the length of the part of the lower thread 4 guided to the gap portion in a chord shape by the second slit 444, the frictional force generated between the part of the lower thread 4 and the front surface side flange portion 39 and between the part of the lower thread 4 and the front surface side part 43 is determined. Therefore, the second slit 444 may be arranged in a manner that the length of the part of the lower thread 4 guided to the gap portion increases, that is, the length of the straight line connecting one end portion and the other end portion of the second slit 444 increases. In other words, the second slit 444 may be arranged in a manner that the straight line connecting one end portion and the other end portion of the second slit 444 gets close to an outer circumference surface of the shaft cylindrical portion 431 as much as possible. Moreover, in order to stably supply the lower thread 4, the second slit 444 may be arranged in a manner that the straight line connecting one end portion and the other end portion of the second slit 444 does not intersect with the outer circumference surface of the shaft cylindrical portion 431.

The second slit 444 is arranged in the side wall part 44 in a circumferential direction between the sewing needle reception region 441 and the first slit 442 and the thread feeding hole 443. Therefore, after the second slit 444 receives the insertion of the lower thread 4 guided by the first slit 442 and the thread feeding hole 443 and guides the lower thread 4 to the gap portion, the second slit 444 can smoothly guide the lower thread 4 upward.

FIG. 13 is a perspective view showing a modification example of the bobbin case 41-3 according to the third embodiment. As shown in FIG. 13, the bobbin case 41-3 in the lower thread supply device of a sewing machine 30-3 according to the third embodiment may further include a thread slip-off prevention plate 445 partially covering the second slit 444. The thread slip-off prevention plate 445 is non-magnetic the same as the other sites of the bobbin case 41-3, that is, formed by a non-magnetic material.

The thread slip-off prevention plate 445 can reduce and prevent the lower thread 4 guided into the second slit 444 from slipping off to the outside of the second slit 444. As shown in FIG. 13, in the thread slip-off prevention plate 445, a guide mechanism which guides the lower thread 4 to the outside and holds the lead-out position of the lower thread is formed in a distal end portion at a lead-out side of the lower thread 4. The guide mechanism of the thread slip-off prevention plate 445 is the same as the guide mechanism formed by the lead-out portion 448 and the claw piece 449 at a distal end side of the leaf spring 447 in the first embodiment. Similar to the lead-out portion 448 and the claw piece 449 in the first embodiment, the guide mechanism of the thread slip-off prevention plate 445 prevents the lower thread 4 from slipping off from the thread slip-off prevention plate 445 and guides the lower thread 4 to the predetermined lead-out position.

As shown in FIG. 13, the thread slip-off prevention plate 445 is fixed to the side wall part 44 only on the shuttle side (the shuttle shaft side) of the second slit 444. Therefore, when the lower thread 4 is guided into the second slit 444, the lower thread 4 can be guided from the front surface side (the shuttle front surface side) to which the thread slip-off prevention plate 445 is not fixed. Moreover, the thread slip-off prevention plate 445 is not limited to this form, and may be a form in which the thread slip-off prevention plate 445 is fixed to the side wall part 44 only on the front surface side (the shuttle front surface side) of the second slit 444 and the lower thread is guided from the shuttle side (the shuttle shaft side).

Moreover, in the third embodiment, a bobbin the same as the bobbin 36-2 according to the second embodiment can be employed as the bobbin 36-3. When the bobbin the same as the bobbin 36-2 according to the second embodiment is employed as the bobbin 36-3 according to the third embodiment, the same as the second embodiment, it may be that the contact member 421 is further added in the bobbin case 41-3, and operational effects the same as the second embodiment can be additionally expected.

As described above, according to the embodiment, in addition to the first embodiment, the bobbin case 41-3 further includes the second slit 444 functioning as the lower thread supply resistance mechanism which applies a resistance action on the supply operation of the lower thread 4 wound around the bobbin 36-3. Therefore, in addition to providing the operational effects the same as the operational effects provided in the first embodiment, the change amount of the tension of the lower thread 4 based on the change in the magnetic force determined by the magnetic force change portion 48 can be increased by the second slit 444 functioning as the lower thread supply resistance mechanism, the magnetic force acting on the front surface side flange portion 39 of the magnetic force member 46. Accordingly, the change width of the tension of the lower thread 4 via the change in the magnetic force of the magnetic force member 46 determined by the magnetic force change portion 48 can be expanded.

In addition, in the embodiment, the second slit 444 arranged in the bobbin case 41-3 serves as the lower thread supply resistance mechanism, the second slit 444 being an example of the lower thread guiding mechanism guiding the lower thread 4 fed from the inside toward the outside to the gap portion between the front surface side part 43 and the front surface side flange portion 39. Therefore, the part of the lower thread 4 guided into the gap portion by the second slit 444 which is an example of the lower thread guiding mechanism can be clamped between the front surface side flange portion 39 and the front surface side part 4 when the front surface side flange portion 39 is attracted by the magnetic force of the magnetic force member 46. Consequently, a frictional force is generated both between the lower thread 4 and the front surface side flange portion 39 and between the lower thread 4 and the front surface side part 43 of the bobbin case 41-3, and thus the resistance action is provided to the supply operation of the lower thread 4 wound around the bobbin 36-3. Due to the resistance action, the change amount of the tension of the lower thread 4 based on the change in the magnetic force determined by the magnetic force change portion 48 can be increased, the magnetic force acting on the front surface side flange portion 39 of the magnetic force member 46, and the change width of the tension of the lower thread 4 via the change in the magnetic force of the magnetic force member 46 determined by the magnetic force change portion 48 can be expanded.

In addition, in the embodiment, the bobbin case 41-3 has the first slit 442 and the second slit 444. The first slit 442 is cut from the shuttle side toward the front surface side in the side wall part 44, receives the insertion of the lower thread 4, and guides the inserted lower thread 4 to the thread feeding hole 443 of the distal end at the front surface side. The second slit 444 serving as the lower thread guiding mechanism is cut along the circumferential direction in the side wall part 44, receives the insertion of the lower thread 4 and guides the lower thread 4 to the gap portion. Therefore, the lower thread 4 is guided to the gap portion by the second slit 444 in a straight line connecting one end portion and the other end portion of the second slit 444, that is, a chord shape when the side wall part 44 is regarded as a column. Therefore, the chord-shaped part of the lower thread 4 guided into the gap portion can be clamped between the front surface side flange portion 39 and the front surface side part 43 when the front surface side flange portion 39 is attracted by the magnetic force of the magnetic force member 46, and thus high resistance action can be stably provided to the supply operation of the lower thread 4 wound around the bobbin 36-3.

Fourth Embodiment

A fourth embodiment is described. In the description below, structural components the same as that in the above embodiment are denoted by the same symbols, and description thereof is simplified or omitted.

<Lower Thread Supply Device of Sewing Machine>

FIG. 14 is an exploded perspective view schematically showing an example of a lower thread supply device of a sewing machine 30-4 according to the fourth embodiment. The lower thread supply device of a sewing machine 30-4 according to the fourth embodiment is obtained by changing the shuttle 31 which is a full rotation shuttle to a shuttle 71 which is a semi rotation shuttle in the lower thread supply device of a sewing machine 30-1 according to the first embodiment, and other configurations are the same. That is, the lower thread supply device of a sewing machine 30-4 according to the fourth embodiment is a device supplying the lower thread 4 from the shuttle 71 which is a semi rotation shuttle.

As shown in FIG. 14, the shuttle 71 which is a semi rotation shuttle is arranged below the needle plate 12 and houses the bobbin case 41-1 and the bobbin 36-1 housed in the bobbin case 41-1. The shuttle 71 has a large shuttle 72, a driver 73, a middle shuttle 74, and a middle shuttle pressing member 75.

The large shuttle 72 is fixedly attached below the needle plate 12 and has a leaf spring in which an opening through which a sewing thread is inserted is formed in the upper part. The large shuttle 72 has a shuttle opening which opens in the −X direction. The large shuttle 72 is configured in a manner that the driver 73 and the middle shuttle 74 are inserted and attached from the +X direction in this order from the shuttle opening, and the driver 73 and the middle shuttle 74 are housed inside together by mounting the middle shuttle pressing member 75 to the shuttle opening.

The driver 73 and the middle shuttle 74 are stored in the large shuttle 72 so as to be reciprocally movable. The large shuttle 72 has an inner circumference surface in sliding contact with an outer circumference surface of the middle shuttle 74 inside the large shuttle 72. The large shuttle 72 allows the reciprocation operation of the middle shuttle 74 around the X-axis by sliding the outer circumference surface of the middle shuttle 74 along the inner circumference surface.

The driver 73 has a substantially arc shape corresponding to a part of the circumference around the X-axis. The driver 73 is fixed to a part at the +X direction side of a shuttle shaft inside the large shuttle 72, and reciprocation is applied to the driver 73 from the shuttle shaft.

Inside the large shuttle 72, the driver 73 alternately comes into contact with the middle shuttle 74 at two contact points in accordance with the reciprocation direction, the two contact points being one end portion and the other end portion of the arc shape corresponding to the part of the circumference around the X-axis. The driver 73 makes the upper thread 3 pass between the driver 73 and the middle shuttle 74 by switching the two contact points, thereby enabling the middle shuttle 74 to pass through a loop of the upper thread 3 from the sewing needle 21.

The middle shuttle 74 has a substantially arc shape corresponding to another part of the circumference around the X-axis and forms approximately one round of the circumference around the X-axis by being combined with the driver 73. The middle shuttle 74 is engaged with the driver 73 at a position at a shuttle front surface side, that is, a position at the −X direction side with respect to the driver 73. The middle shuttle 74 is applied with reciprocation from the driver 73.

The middle shuttle 74 has, on an outer circumference, an outer circumference surface in sliding contact with the inner circumference surface of the large shuttle 72. The middle shuttle 74 can reciprocate around the X-axis inside the large shuttle 72 in a manner that the outer circumference surface slides along the inner circumference surface of the large shuttle 72.

The middle shuttle 74 has, at one end portion of the outer circumference surface in a forward direction, a point which scoops the loop of the upper thread 3 from the sewing needle 21 when the middle shuttle 74 rotates in the forward direction, that is, when the middle shuttle 74 rotates in a clockwise direction as viewed from the shuttle front surface side. The sewing machine 1 according to the fourth embodiment forms the seam 5 in a manner that the loop of the upper thread 3 from the sewing needle 21 is scooped by the point of the middle shuttle 74 from below the needle plate 12, and the loop of the upper thread 3 and the lower thread 4 supplied from the bobbin 36-1 described later are entangled.

The middle shuttle 74 has a storage portion which stores and holds the bobbin 36-1 and the bobbin case 41-1 at the shuttle front surface side. The middle shuttle 74 has a spindle 741 which is erected in the storage portion in the −X direction toward the shuttle front surface side and supports the bobbin 36-1 and the bobbin case 41-1. The spindle 741 is positioned at the center of the reciprocation of the middle shuttle 74 and is concentric with the shuttle shaft inside the large shuttle 72 when the middle shuttle 74 is housed in the large shuttle 72. The spindle 741 has a circumferential groove arranged around the outer circumference at the distal end portion. The circumferential groove of the spindle 741 can be fitted with the inner edge of the opening at the center of the latch lever described later.

The spindle 741 may be non-magnetic, in other words, is formed by a non-magnetic material; in this case, an attraction force of the magnetic force member 46 described later to the middle shuttle 74 can be reduced to about one-third as compared with a case that the spindle 741 is magnetic. Accordingly, the attraction force of the magnetic force member 46 to the front surface side flange portion 39 of the bobbin 36-1 can be increased to about twice as compared with a case that the spindle 741 is magnetic.

The middle shuttle pressing member 75 is attached to the shuttle front surface side of the large shuttle 72 and functions as a lid which covers the entire periphery of an opening end region of the shuttle opening of the large shuttle 72. The middle shuttle pressing member 75 stably supports the driver 73 and the middle shuttle 74 stored inside the large shuttle 72 in the X-axis direction which is a back-forth direction of the shuttle 71.

The middle shuttle pressing member 75 has a small opening having a diameter smaller than that of the shuttle opening of the large shuttle 72 at the center. Through the small opening, the middle shuttle pressing member 75 may insert the bobbin 36-1 and the bobbin case 41-1 into the storage portion of the middle shuttle 74 or may take out the bobbin 36-1 and the bobbin case 41-1 stored in the storage portion of the middle shuttle 74.

Moreover, in the fourth embodiment, a form can be further employed in which the bobbin case 41-1 is changed to the bobbin case 41-2 according to the second embodiment and the bobbin 36-1 is changed to the bobbin 36-2 according to the second embodiment. In this case, operational effects the same as the second embodiment can be additionally expected.

In addition, in the fourth embodiment, a form can be further employed in which the bobbin case 41-1 is changed to the bobbin case 41-3 according to the third embodiment. In this case, operational effects the same as the third embodiment can be additionally expected.

In the above description, according to the embodiment, except that the shuttle 31 which is a full rotation shuttle is changed to the shuttle 71 which is a semi rotation shuttle, the same configuration as the first embodiment is included, and thus operational effects the same as the first embodiment are provided.

According to the aspect of the disclosure, the adjustment of the tension of the lower thread of the sewing machine can be facilitated.

What is claimed is:

1. A lower thread supply device of a sewing machine which is arranged below a needle plate of a sewing machine, comprising:

a bobbin which has a cylindrical portion for inserting into a spindle of a shuttle arranged below the needle plate, a shuttle side flange portion which is formed at an end portion at a shuttle side which is a side facing the shuttle of the cylindrical portion, and a front surface side flange portion which is magnetic and formed at an end portion at a front surface side which is a side opposite to the side facing the shuttle of the cylindrical portion, wherein a lower thread is wound around an outer circumference of the cylindrical portion between the shuttle side flange portion and the front surface side flange portion;

a bobbin case which has a non-magnetic cover portion housing the bobbin and transmitting a magnetic force, wherein the cover portion has a front surface side part covering the front surface side of the bobbin and a side wall part covering an outer circumference side of the bobbin;

a magnetic force member which is arranged at the front surface side of the bobbin case and attracts the front surface side flange portion of the bobbin by a magnetic force via the bobbin case; and a magnetic force change portion which changes the magnetic force of the magnetic force member acting on the front surface side flange portion, the bobbin case further comprises a first lower thread supply resistance mechanism which gives a resistance action to the supply operation of the lower thread wound around the bobbin, the first lower thread supply resistance mechanism is a contact member arranged in contact with the bobbin on an inner surface of the bobbin case, the bobbin further comprises a taper portion inclined toward the shuttle side in an outer circumference portion of the front surface side flange portion, and the contact member arranged in the bobbin case is arranged in contact with the taper portion in a region facing the taper portion on an inner surface of the front surface side part.

2. The lower thread supply device of a sewing machine according to claim 1, wherein the magnetic force member is a magnet, and the magnetic force change portion is a drive portion which relatively moves the magnet with respect to the front surface side flange portion.

3. The lower thread supply device of a sewing machine according to claim 1, wherein the magnetic force member is an electromagnet, and the magnetic force change portion is a power supply portion which changes a current applied to the electromagnet.

4. The lower thread supply device of a sewing machine according to claim 1, wherein the contact member is further arranged into an arc shape to avoid a sewing needle reception region which receives insertion of a sewing needle of the sewing machine.

5. The lower thread supply device of a sewing machine according to claim 1, wherein the bobbin case further comprises a thread feeding hole which is arranged at a position facing an axial central portion of the cylindrical portion n the side wall part and feeds the lower thread from an inside to an outside.

6. The lower thread supply device of a sewing machine according to claim 1, wherein the bobbin case further comprises a second lower thread supply resistance mechanism which gives a resistance action to the supply operation of the lower thread wound around the bobbin, the second lower thread supply resistance mechanism is a lower thread guiding mechanism which is arranged in the bobbin case and guides the lower thread fed from an inside toward an outside to a gap portion between the front surface side part and the front surface side flange portion.

7. The lower thread supply device of a sewing machine according to claim 6, wherein the bobbin case further comprises a first slit which is cut from the shuttle side toward the front surface side in the side wall part, receives the insertion of the lower thread, and guides the inserted lower thread to a thread feeding hole of a distal end at the front surface side, and the lower thread guiding mechanism arranged in the bobbin case is a second slit which is cut along a circumferential direction in the side wall part, receives the insertion of the lower thread and guides the lower thread to the gap portion.

8. The lower thread supply device of a sewing machine according to claim 7, wherein the bobbin case further comprises a thread slip-off prevention plate for partially covering the second slit.

9. The lower thread supply device of a sewing machine according to claim 7, wherein the thread feeding hole is arranged at the position in the side wall part facing the axial central portion of the cylindrical portion.

* * * * *